United States Patent [19]

Clem

[11] Patent Number: 4,501,788

[45] Date of Patent: Feb. 26, 1985

[54] WATERPROOFING SOIL

[75] Inventor: Arthur J. Clem, Chicago, Ill.

[73] Assignee: Clem Environmental Corp., Chicago, Ill.

[21] Appl. No.: 430,685

[22] Filed: Sep. 30, 1982

Related U.S. Application Data

[63] Continuation-in-part of Ser. No. 238,701, Feb. 27, 1981, abandoned.

[51] Int. Cl.[3] ..... B32B 5/16

[52] U.S. Cl. ..... 428/240; 405/107; 405/116; 427/136; 428/245; 428/261; 428/262; 428/289; 428/325; 428/454; 428/913

[58] Field of Search ..... 405/107, 116, 263, 270; 427/136, 245; 428/240, 245, 246, 251, 268, 283, 284, 285, 325, 454, 70, 261, 262, 289, 913; 106/DIG. 4

[56] References Cited

U.S. PATENT DOCUMENTS

| | | | |
|---|---|---|---|
| 3,186,896 | 6/1965 | Clem | 428/454 |
| 3,991,247 | 11/1976 | Grubb | 428/268 |
| 4,048,373 | 9/1977 | Clem | 428/454 |
| 4,139,588 | 2/1979 | Clem | 264/232 |
| 4,209,568 | 6/1980 | Clem | 428/454 |

*Primary Examiner*—James J. Bell

*Attorney, Agent, or Firm*—John Vander Weit, Jr.

[57] ABSTRACT

A method and a product providing for waterproofing soil utilizing a flexible non-biodegradable support capable of venting gas coated with water swellable bentonite and covering the soil to be waterproofed with the coated support.

16 Claims, 5 Drawing Figures

WATERPROOFING SOIL

CROSS REFERENCE TO RELATED APPLICATIONS

This application is a continuation-in-part of my application Ser. No. 06/238,701; filed Feb. 27, 1981, now abandoned.

BACKGROUND OF THE INVENTION

The present invention relates to a moisture impervious sheet particularly suitable for environmental pollution control as a water barrier for the building of ponds, lagoons and as a soil sealent for hazardous or nuclear waste having a flexible non-biodegradable support capable of venting gas and coated with an adhesive and water swellable bentonite in such a manner so as to retain its flexibility.

Various rigid panels useful in construction have been defined in prior U.S. Pat. Nos. 3,186,896; 4,048,373; 4,070,839; and 4,139,588 granted to Arthur G. Clem relating to panels and utilizing bentonite to form water barriers. In another U.S. Pat. No. 4,209,568, issued to Arthur G. Clem, there is disclosed a bentonite containing gelled oil waterproofing composition which is useful for coating the walls of various constructions to provide waterproof barriers. However, the instant invention is concerned with providing waterproof barriers for ponds, lagoons and hazardous waste sites. These present particular problems in the fact that they are extremely large areas and may be subjected to extreme forces, pressures and movement. Under such conditions rigid construction materials would be too hard to work with and extremely difficult to maintain.

Some waste matter from industrial operations is noxious, hazardous or toxic. The full listing is too large to include, but some samples would be uranium tailing, spend radioactive matter, acid metal salt solutions and the insoluble lime salts thereof, metallic pigments, acidified sludges from crude oils, spent lubricating oils, solvents, paints, polychlor biphenyls, DDT, and similar poisons. Many of these are insoluble or sparingly soluble in water. But waste acids from some waste sources could inter-react with some insoluble metal waste to generate a toxic metal solution leachate.

Leachate from hazardous waste must not enter the groundwater supply. If it does, large sources of drinking water may be contaminated for lengthy periods of time. For this reason, hazardous waste is sometimes stored in clay mines with three meters or more of native clay below the waste material.

More frequently, the soil at the waste disposal site may be permeable to some degree. If "clay" soil is available, it may be moved into the site, spread, disintegrated and moistened to the condition of maximum compactability, then rolled or temped in fifteen cm to twenty cm layers to form an impermeable surface. The surface cover may be in the sixty to one hundred centimeter thickness range. A simple calculation will show that this cover coat will significantly reduce storage volume, or will require extra earth excavation to maintain the original design volume.

If native clay soil is not present, or cannot be moved into the landfill site, one method of sealing soil has been that of a plastic sheet, laid on the ground, with seams overlapped and welded or cemented. Plastic sheets or films have many problems. Some are sensitive to ultraviolet light, and must be protected by a layer of dirt.

Sheets must be joined in the field and there is a potential for leakage at each seam. Many plastic films are destroyed by hydrocarbons reducing the number of waste products that can be stored. Also, leaking organic matter passing through pinholes in the plastic liner may cause gas which will cause the liner to rise. If the liner rises it will usually tear or break and destroy the seal or waterproofing of the contaminant.

Porous soils may be sealed with colloidal bentonite to store hazardous waste. The bentonite is spread over the surface intimately mixed with soil to a depth of ten cm, moistened to optimum moisture, remixed and compacted. This too has limitations. The resulting mixture must be uniform or some zones will leak while others will be highly impermeable.

In accordance with the present invention, a method and product are provided which will allow formation of a flexible sheet with waterproofing qualities and which is suitable for use over large areas by covering the soil or other areas with the treated sheet.

SUMMARY OF THE INVENTION

An object of the invention is to provide a flexible sheet suitable for use over large areas which will provide a waterproof barrier.

Another object of the invention is to provide a method of affixing water swellable bentonite to a flexible non-biodegradable support capable of venting gas in such a manner as to retain flexibility and provide a water impervious barrier.

Still another object of the invention is to provide a water impervious sheet which may be applied to soil so as to provide a water barrier for ponds, lagoons or hazardous waste sites.

While the invention will be described in connection with a preferred embodiment and procedure, it will be understood that it is not intended to limit the invention to that embodiment and procedure. On the contrary, it is intended to cover all alternatives, modifications and equivalents as may be included within the spirit and scope of the invention as defined by the appended claims.

BRIEF DESCRIPTION OF THE DRAWINGS

Other objects and advantages of the invention will become apparent upon reading the following detailed description and upon reference to the drawings, in which.

DETAILED DESCRIPTION OF THE PREFERRED EMBODIMENT

Figure 1:
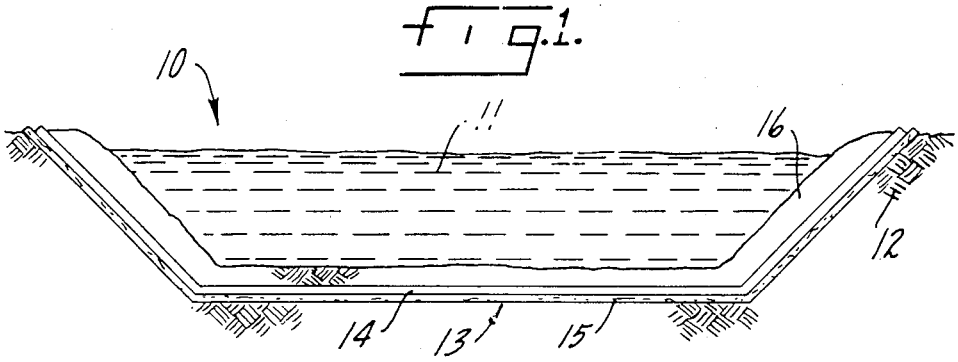
FIG. 1 is a side sectional view of a hazardous waste site incorporating the principles of the instant invention.

Turning first to FIG. 1, there is shown a hazardous waste site utilizing the products and methods of the instant invention. Hazardous waste site 10 may contain any of the contaminants and water soluble poisons enumerated previously. It may be a liquid as shown or a sludge or solid. The soil 12 is any type of porous soil or soil which one desires to protect from contamination. The hazardous waste solution 11 contacts initially a protective surface of soil 16 which placed over a sheet 13 constructed in accordance with the instant invention. Sheet 13 includes a continuous water impermeable barrier 14 which is presented by a water swellable bentonite used in the instant invention. Sheet 13 also includes a gas venting layer 15 which is presented by a flexible non-biodegradable support capable of venting gas described in the instant invention. Flexible support layer 15 allows built up vapors or gases which are generated by organic decay or other decomposition of materials in the soil to escape to the atmosphere above the surface of the hazardous waste site or be collected for other disposal as desired. Thus layer 15 is shown in use as extending at its edges above soil 12 when venting gases to the atmosphere. The water swellable bentonite forms a water impermeable barrier 14 as defined more specifically later. Protective coating of soil 16 is not necessary, however it is desirable when the waste site may be filled with sharp materials or other waste that could possibly dent or puncture the barrier such as drums or other containers. If the waste material 11 is solid, it may be desirable to enclose it with another sheet constructed in accordance with the instant invention placed over the top of the waste site. In this use, the gas venting layer 15 of sheet 13 would be adjacent to the top of waste site 11 and the water impermeable barrier 14 would be above the gas venting barrier to further decrease the chances of water entering the waste site. In this top seal use, the area to be waterproofed is actually the atmosphere, since it is desired to stop precipitation such as rain, snow or the like from entering the waste material 11. This would diminish overflow from the waste site or build up of water pressure in the waste site.

Figure 2:
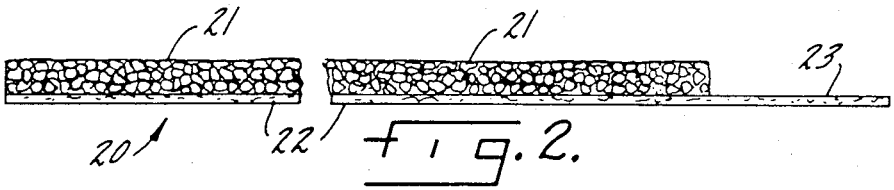
FIG. 2 is a side view of one embodiment of the instant invention.
Figure 3:
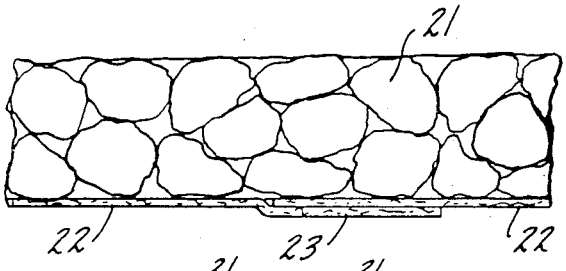
FIG. 3 is a side view of an embodiment of the instant invention showing a product in use.
Figure 4:
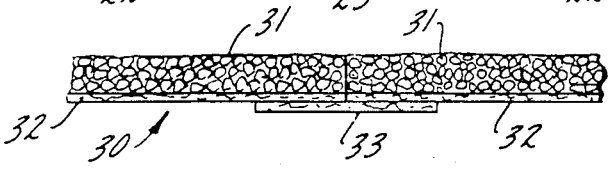
FIG. 4 is a side view of another embodiment of the instant invention.

Turning to FIG. 2, a side view of a sheet constructed in accordance with the instant invention is shown. Sheet 20 includes a porous flexible non-biodegradable support capable of venting gas 22 which is coated with water swellable bentonite 21. The coating of bentonite can be affixed by most common adhesives and it is preferred to have a coating in the range of three to ten millimeters in order to provide an adequate water barrier. The ten mm thickness, for example, may be used as the base of a waste fill site to halt leachate seepage. The thinner three mm seal can be used as a top seal covering over a filled site to halt penetration of rain or snow into the stored waste material. In either case, the gas venting layer is under the bentonite coating water barrier. A portion of the flexible non-biodegradable support capable of venting gas is extended beyond the edge of the coating of water swellable bentonite at edge 23 so as to allow for installation with overlap so that a continuous layer of gas venting material can be provided. As shown in FIG. 3, in common use, edge 23 of one sheet 20 is overlapped over the support 22 of another sheet 20 of the instant invention. As is shown in FIG. 3, the bentonite coating 21 swells up to form a water impermeable barrier and forms a continuous barrier across adjacent sheets 20 and the overlapping edge 23 of one support 22 forms a continuous layer with the porous support 22 of the adjacent sheet 20. In another installation, as shown in FIG. 4, a sheet 30 with a porous non-biodegradable support 32 capable of venting gas coated with water swellable bentonite 31 is shown lined up next to another sheet containing a porous non-biodegradable support 32 and bentonite coating 31. Under the seam between the sheets a strip of porous non-biodegradable support material 33 capable of venting gas is positioned so as to provide a continuous layer between adjacent sheets 30 and supports 32. The bentonite coatings 31 of each sheet will swell and self seam themselves to form a continuous barrier when moistened.

Figure 5:
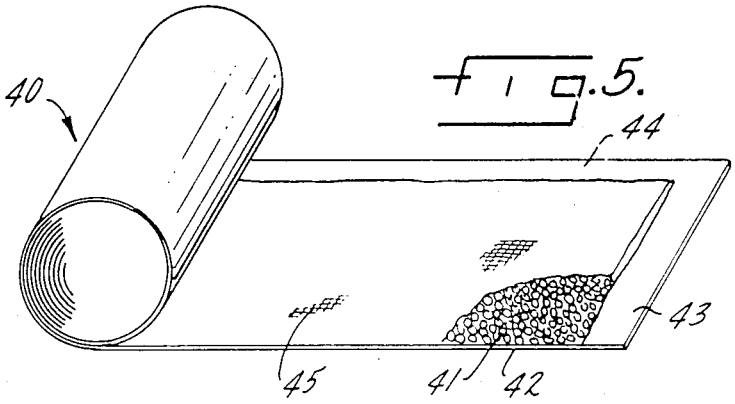
FIG. 5 is a perspective fragmentary view of still another embodiment of the instant invention, While the invention will be described in connection with a preferred embodiment and procedure, it will be understood that it is not intended to limit the invention to that embodiment and procedure. On the contrary, it is intended to cover all alternatives, modifications and equivalents as may be included within the spirit and scope of the invention as defined by the appended claims.

In a preferred embodiment, FIG. 5 shows a sheet 40 which is formed by a flexible non-biodegradable support capable of venting gas 42 which is coated with bentonite 41 and has extending edges 43 and 44 along two sides of the roll to allow overlapping of supports 42 to provide a continuous gas venting layer. Additionally a cover mat 45 is affixed to or otherwise fastened to the top of the bentonite coating 41 so as to provide a protective retainer for retention of possible loose particles of bentonite which may be dislodged during transfer or use. A preferred width of edges 43 and 44 is in the range of two to three cm.

The bentonite utilized in the present invention is one which will hydrate in the presence of water, i.e., will swell in the presence of water. A preferred bentonite is sodium bentonite which is basically a hydratable montomorillonite clay which has sodium as its predominate exchangeable ion. However, the bentonite utilized in the present invention may also contain other cations such as magnesium and iron. The particular cation contained in the bentonite is not important. As noted above, the sodium bentonite will swell in water and is therefore the type of bentonite which is useful in the present invention.

Some physical characteristics which distinguish bentonite from other clays are its permeable texture and its extremely small grain size. The grain particles, when wetted, absorb films of water that are thicker than the films which form on other claylike materials, and after the bentonite has been wetted, the water cannot be expelled, even at high pressures. The strong absorptive power of commercial bentonite which will absorb almost 5 times its weight of water is partially attributable to the preponderance of extremely small grains or particles, providing tremendous surface area for the exertion of absorptive powers and the film retaining capacity of these particles. Commercial bentonite swells when contacted with water as much as ten to fifteen times its dry volume. One factor which causes this swelling is the separation of the small particles by the water films absorbed thereon. Another is the distinctive nature of the particles themselves, which are composed of minute platelike structures that possess the peculiar property of allowing water molecules to penetrate their crystal lattice. The crystal structure itself is thus expanded. A third factor is the mutual repulsion of the particles due to like negative polarity. In its swollen condition, bentonite has several advantageous properties; it will carry materials in suspension; it exerts a cohesive effect; when left quiescent it forms a permanent gel, the viscosity of which increases upon aging. An important aspect of the swelling of bentonite is that it will swell only to the extent necessary to fill available space without exerting substantial pressure when confined against further swelling. A particularly preferred type of bentonite is that known as colloidal Wyoming bentonite.

The porous non-biodegradable support of the instant invention may be in sheet or roll form. It may be of a non-biodegradable material capable of venting gas, fabric, fiberglass or woven or non-woven cloth. It must be flexible and it is preferred that the support be resistant to shearing. The porous non-biodegradable support must be capable of venting gas. This is necessary to allow various gases from the soil below the waste site to travel through the layer formed by the porous sheet to the atmosphere. By the term "capable of venting gas", it is meant that the non-biodegradable support should have a lateral or planar permeability of at least $1\times10^{-6}$ cm/sec. and a preferred lateral permeability of $1\times10^{-3}$ cm/sec. The lateral permeability in cm/sec. is the rate of travel of the gas laterally through the material. Usually materials will have identical or very similar normal permeability and lateral permeability. For example several materials sold by Monsanto under the names Bidem C-22, Bidem C-28, Bidem C-34, Bidem C-38 and Bidem C-42 have a normal permeability of 0.3 cm/sec. and a planar permeability of 0.3 cm/sec. A material sold by Celanese as Mirafi 600X has a normal permeability of 0.01 cm/sec. and a lateral permeability of 0.01 cm/sec. A material sold by Phillips Fiber Corporation under the name SUPAC 5-P has a normal permeability of 0.05 cm/sec. and a lateral permeability of 0.03 cm/sec. Another material sold by Phillips Fiber Corporation under the name SUPAC 8-P has a normal permeability of 0.08 cm/sec. and a lateral permeability of 0.05 cm/sec. A preferred material is a non-woven fabric such as one sold by Phillips Fiber Corporation under the trademark of SUPAC 5-P.

Measurments of normal permeability were conducted for the Phillips SUPAC 5-P and Kraft paper used in Volclay panels sold under U.S. Pat. No. 3,186,896. ASTM test D737-75 (Reapproved 1980) was used to measure the air permeability. It was found that SUPAC 5-P had an air permeability of 7936.33 liters per minute per square foot of fabric, while Kraft paper had 0.00 liters per minute per square foot. Accordingly, Kraft paper is not capable of venting gas and is biodegradable as well. Thus, Kraft paper is not suitable or even functional for the support.

While normal permeability is important, lateral permeability is critical to the proper functioning of the gas venting support. The normal permeability may be lower than the lateral permeability as long as it does not restrict entry of gases into the gas venting support. Since the entire surface area of the gas venting support is available for gas entry, but only the cross-sectional area of the gas venting support is available for transfer of the gas to the edges or then to the atmosphere, lateral permeability of the gas venting support will be the limiting factor in selection of a material for the gas venting support. The minimum normal permeability for the support would be $1\times10^{-7}$ cm/sec. The minimum lateral permeability for a material "capable of venting gas" as used in the gas venting support is $1\times10^{-6}$ cm/sec. However, for most applications, a lateral permeability of greater than $1\times10^{-3}$ cm/sec. is preferred. For Phillips SUPAC 5-P a highly preferred lateral permeability of $3\times10^{-2}$ cm/sec. is achieved.

The selection of material for the gas venting sheet will depend on the application involved. If low quantities of gases are to be vented a lower permeability material may be used. For high quantities of gas, a higher permeability material may be used. Since lateral permeability may vary by factors of 10,000 or more, it is the influential factor in selecting a material rather than changing the thickness of the gas venting support.

Although, it is usually sufficient to vent the gas collected by the gas venting support to the atmosphere, it is often desirable to pass the collected gas through a gas treating means first. For example, if the gases have an obnoxous odor and can be changed into less obnoxous substances by burning, then the gas venting support can be connected to burners. Other similar waste gas treatment means may be used as desired for the treatment of the collected gases prior to their release to the atmosphere.

The adhesive may be a sodium silicate, starch, animal glue, polymer suspension or latex vehicle such as those used for water based paints. One type of adhesive suitable is sold commercially under the trademark of "Elmer" glue. Other water soluble substances may be dextrine, CMC adhesive, linoleum cement. Water insoluble adhesives such as latex emulsions, rubber cement or resins dissolved in suitable solvents may be used.

In preparing the products of the instant invention, the porous non-biodegradable support is coated with the adhesive and while the adhesive is still wet, the bentonite is spread over the sticky surface. The bentonite is used in the form of a powder or granules. A layer will attach to the wet sticky surface. The support is then dried and can be processed further to allow convenience in use as a soil water barrier. Thus the porous support may be rolled or folded for transport.

What is surprising is that the dried sheet when subjected to water will form a water impervious barrier. One might expect that when the bentonite is spread on a water based adhesive, that it would swell to such an extent that after drying and upon later contact with water, that the coating would have places where seepage or leaks would occur. The porous support can be coated with multiple applications on each side as desired.

In utilization of the treated sheets in soil sealing, the soil is preferably compacted, the sheets are spread over the soil and the edges of the sheets are overlapped. This will provide a waterproof barrier. Preferably the sheets are then covered with a protective coating of earth. This will provide protection of the sheet from puncturing and also help maintain the sheets securely in place.

Thus it is apparent that there has been provided, in accordance with the invention, a method and product that fully satisfies the objects, aims, and the advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

I claim:

1. A flexible sheet for providing a water barrier comprising a flexible non-biodegradable support capable of venting gas and coated with water swellable bentonite.

2. A flexible sheet as in claim 1, wherein said flexible non-biodegradable support capable of venting gas has a lateral gas permeability of greater than $1\times10^{-6}$ cm/sec.

3. A flexible sheet as in claim 1, wherein said flexible non-biodegradable support capable of venting gas has a lateral gas permeability of greater than $1\times10^{-3}$ cm/sec.

4. A flexible sheet as in claim 1, wherein said flexible non-biodegradable support capable of venting gas has a lateral gas permeability of greater than $1\times10^{-2}$ cm/sec.

5. A flexible sheet as in claim 1, wherein said flexible non-biodegradable support capable of venting gas is made of a material selected from the group consisting of woven or non-woven fabrics and has a lateral gas permeability of greater than $1\times10^{-3}$ cm/sec.

6. A flexible sheet as in claim 1, wherein said water swellable bentonite coating is between three and ten cm thick.

7. A flexible sheet as in claim 1, wherein on at least one edge of said sheet, the flexible non-biodegradable support is not coated with said water swellable bentonite.

8. A flexible sheet as in claim 1, wherein said coating of water swellable bentonite is covered with a mat capable of retaining dislodged particles of said water swellable bentonite coating.

9. A sheet as in claim 8, wherein said flexible non-biodegradable support is in roll form and said coating of water swellable bentonite does not cover two adjacent edges of said support.

10. A method for forming a water impervious flexible sheet comprising coating a flexible non-biodegradable support capable of venting gas with a liquid adhesive, spreading a water swellable bentonite on said liquid adhesive, and drying said coated support.

11. A method as in claim 10, wherein before drying said coated support, at least one more coating with a liquid adhesive and spreading of water swellable bentonite on said liquid adhesive is made.

12. A method as in claim 10, wherein, before drying said coated support, a mat is placed over the water swellable bentonite coating.

13. A method for waterproofing an area of soil comprising coating a flexible non-biodegradable support capable of venting gas with a water swellable bentonite providing a barrier of water swellable bentonite to provide coated sheets, covering the soil to be waterproofed with a plurality of said coated sheets with said coating of bentonite facing up and said support capable of venting gas facing down and aligning each sheet so that there is uninterrupted contact of each of said bentonite barriers and each of said supports capable of venting gas in order to provide a continuous and uninterrupted barrier of bentonite facing the area from which water is to be barred and continuous and uninterrupted layer of non-biodegradable support capable of venting gas with said support capable of venting gas open at least partially to the atmosphere.

14. A method as in claim 13, wherein said coated sheets are then covered with a protective layer of soil.

15. A method as in claim 13, wherein said coated sheets are placed both below and above the area from which water is to be barred.

16. A method as in claim 13, wherein said support capable of venting gas is only open to the atmosphere after traveling through a gas treatlng means.

* * * * *